US008956178B2

(12) United States Patent
Chen

(10) Patent No.: US 8,956,178 B2
(45) Date of Patent: Feb. 17, 2015

(54) POGO PIN CONNECTOR ASSEMBLY

(71) Applicant: Cheng Uei Precision Industry Co., Ltd., New Taipei (TW)

(72) Inventor: Yung Yi Chen, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 112 days.

(21) Appl. No.: 13/907,848

(22) Filed: May 31, 2013

(65) Prior Publication Data

US 2014/0357115 A1 Dec. 4, 2014

(51) Int. Cl.
*H01R 13/64* (2006.01)
*H01R 13/62* (2006.01)
*H01R 13/648* (2006.01)

(52) U.S. Cl.
CPC ..... *H01R 13/62* (2013.01); *H01R 13/6485* (2013.01)
USPC ..... 439/374

(58) Field of Classification Search
CPC ..... H01R 13/62; H01R 13/6485
USPC ..... 439/74, 347, 374–381, 700
See application file for complete search history.

(56) References Cited

U.S. PATENT DOCUMENTS

| | | | | |
|---|---|---|---|---|
| 4,609,243 | A * | 9/1986 | Wyss | 439/44 |
| 5,092,774 | A * | 3/1992 | Milan | 439/66 |
| 8,062,078 | B2 * | 11/2011 | Asai et al. | 439/823 |
| 8,337,256 | B1 * | 12/2012 | Lin | 439/700 |
| 8,808,037 | B2 * | 8/2014 | Park | 439/700 |

* cited by examiner

*Primary Examiner* — Khiem Nguyen
(74) *Attorney, Agent, or Firm* — Cheng-Ju Chiang

(57) ABSTRACT

A pogo pin connector assembly includes a supporting body, at least one probe terminal inserted upward in the supporting body, an insulating body and at least one docking terminal inserted upward in the insulating body. A top face of the supporting body is concaved downward to form a slide slot. The probe terminal has a barrel, a plunger and a soldering portion. A bottom face of the insulating body protrudes downward to form a slide rib. The docking terminal has a docking portion and a positioning portion. In use, the slide rib of the insulating body is positioned in the slide slot of the supporting body and slides along the slide slot to guide the insulating body to slide forward on the supporting body until the plunger of the probe terminal electrically docks with the docking portion of the corresponding docking terminal.

10 Claims, 5 Drawing Sheets

POGO PIN CONNECTOR ASSEMBLY

BACKGROUND OF THE INVENTION

1. Field of the Invention

The present invention relates to a connector assembly, and more particularly to a pogo pin connector assembly.

2. The Related Art

Referring to FIG. 5, a traditional pogo pin connector assembly includes a supporting body 10' defining a plurality of probe terminal holes 11', a plurality of probe terminals 20' which are inserted in the probe terminal holes 11', an insulating body 30' defining a plurality of docking terminal holes 31', and a plurality of docking terminals 40' which are inserted in the docking terminal holes 31'. For the convenience of following description, a surface of the supporting body 10' from which the probe terminals 20' project out to electrically connect with the docking terminals 40' is designated as a mating surface (not labeled).

The insulating body 10' together with the probe terminals 20' is fixed in a shell (not labeled) with the mating surface thereof being exposed outside the shell. In use, the insulating body 30' is mated with the mating surface of the supporting body 10' to make the docking terminals 40' and the probe terminals 20' axially dock with one another so as to form the pogo pin connector assembly. However, the above-mentioned pogo pin connector assembly takes too much space, and arc spark easily occurs before all of the probe terminals 20' and the corresponding docking terminals 40' contact completely.

SUMMARY OF THE INVENTION

Accordingly, an object of the present invention is to provide a pogo pin connector assembly. The pogo pin connector assembly includes a pogo pin connector and a docking connector. The pogo pin connector includes a supporting body and at least one probe terminal. The supporting body defines at least one fastening hole penetrating vertically through the supporting body. A top face of the supporting body is concaved downward to form a slide slot extending along a front-to-rear direction and penetrating through the back end of the supporting body. The probe terminal is inserted upward in the fastening hole of the supporting body. The probe terminal has a barrel, a plunger elastically inserted in the barrel and projecting out of a top end of the barrel, and a soldering portion formed at a bottom end of the barrel. The docking connector includes an insulating body and at least one docking terminal. The insulating body defines at least one positioning hole corresponding to the fastening hole of the supporting body and penetrating vertically through the insulating body. A bottom face of the insulating body protrudes downward to form a slide rib extending along a front-to-rear direction. The docking terminal is inserted upward in the positioning hole of the insulating body. The docking terminal has a docking portion and a positioning portion extending upward from a top end of the docking portion. When the pogo pin connector docks with the docking connector, the slide rib of the insulating body is positioned in the slide slot of the supporting body and slides along the slide slot to guide the insulating body to slide forward on the supporting body until the plunger of the probe terminal electrically docks with the docking portion of the corresponding docking terminal.

As described above, the pogo pin connector assembly utilizes the slide-out combine structure to slidably dock the docking connector with the pogo pin connector, so that can save a lot of space.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
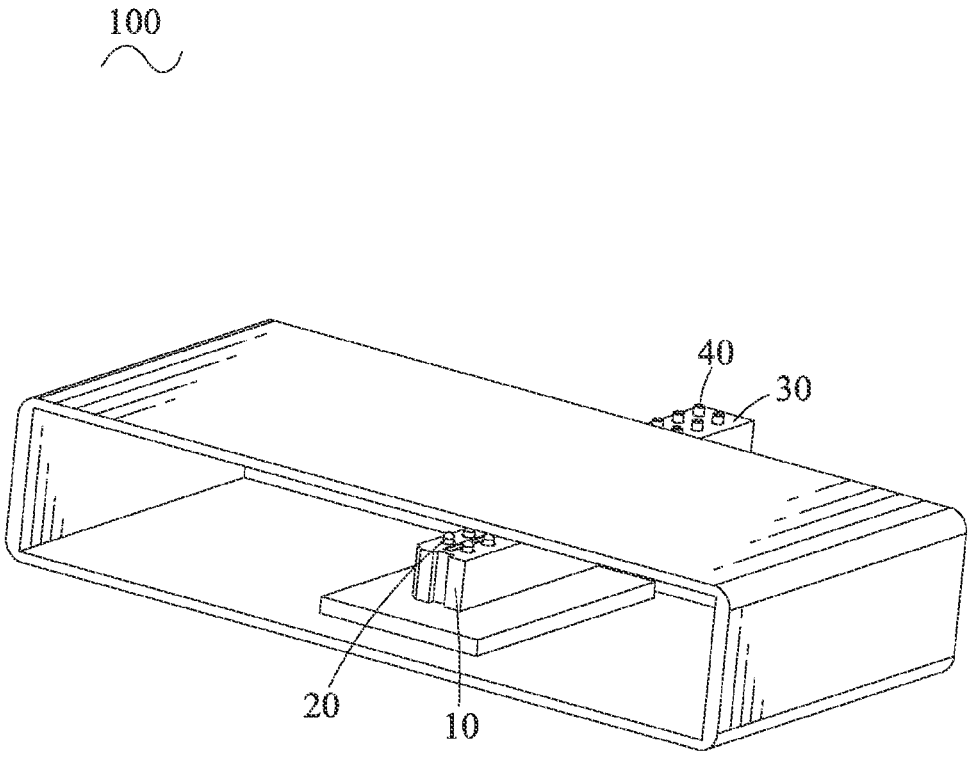
FIG. 1 is an assembled, perspective view of a pogo pin connector assembly in accordance with an embodiment of the present invention.
Figure 2:
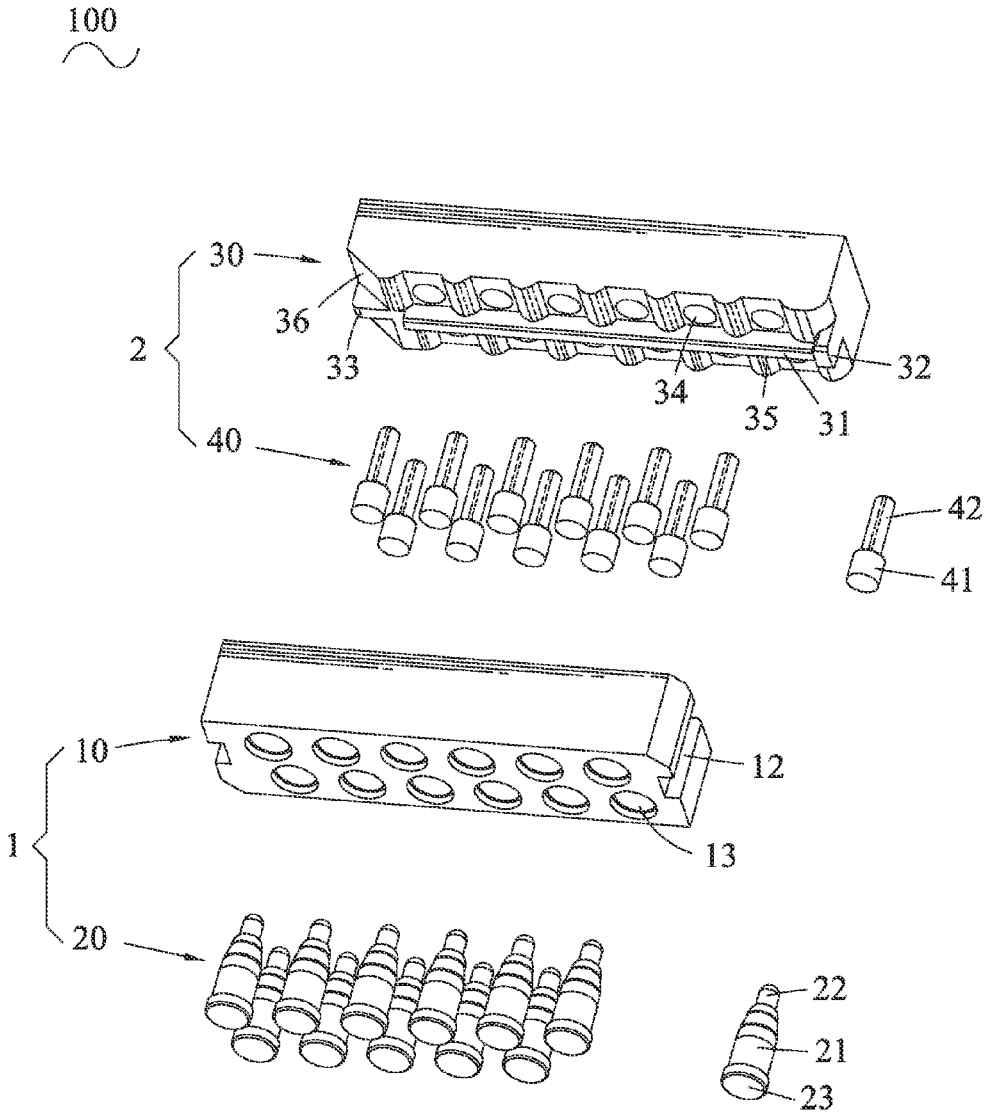
FIG. 2 is an exploded, perspective view of the pogo pin connector assembly shown in FIG. 1.

Referring to the drawings in greater detail, and first to FIG. 1 and FIG. 2, an embodiment of the present invention is embodied in a pogo pin connector assembly 100. The pogo pin connector assembly 100 includes a pogo pin connector 1 and a docking connector 2.

Figure 3:
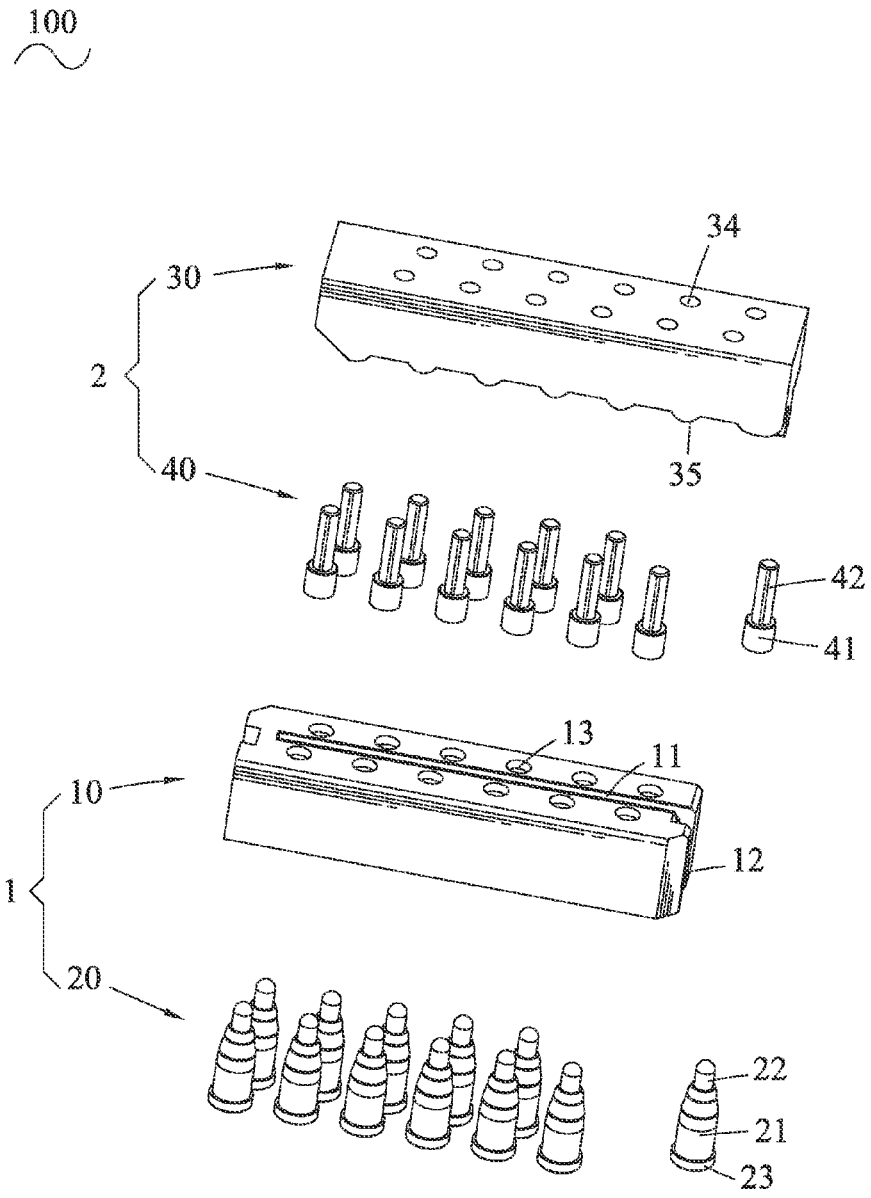
FIG. 3 is another exploded, perspective view of the pogo pin connector assembly shown in FIG. 1.
Figure 4:
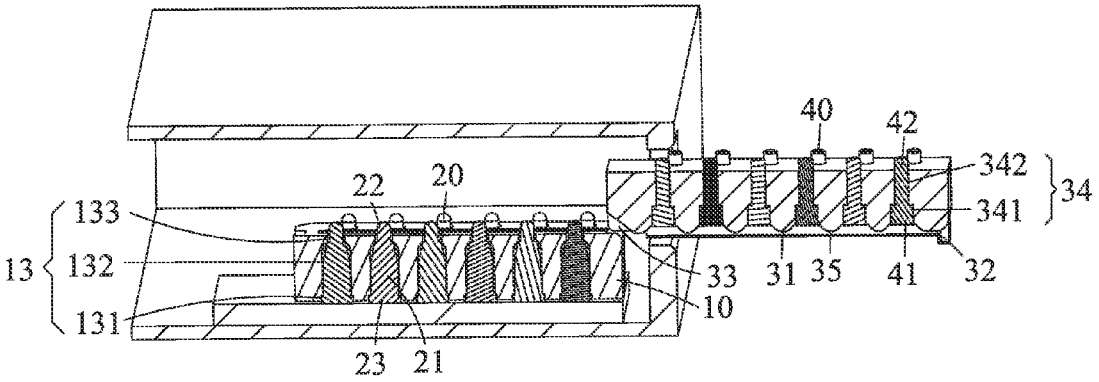
FIG. 4 is a cross-sectional view of the pogo pin connector assembly shown in FIG. 1.
Figure 5:
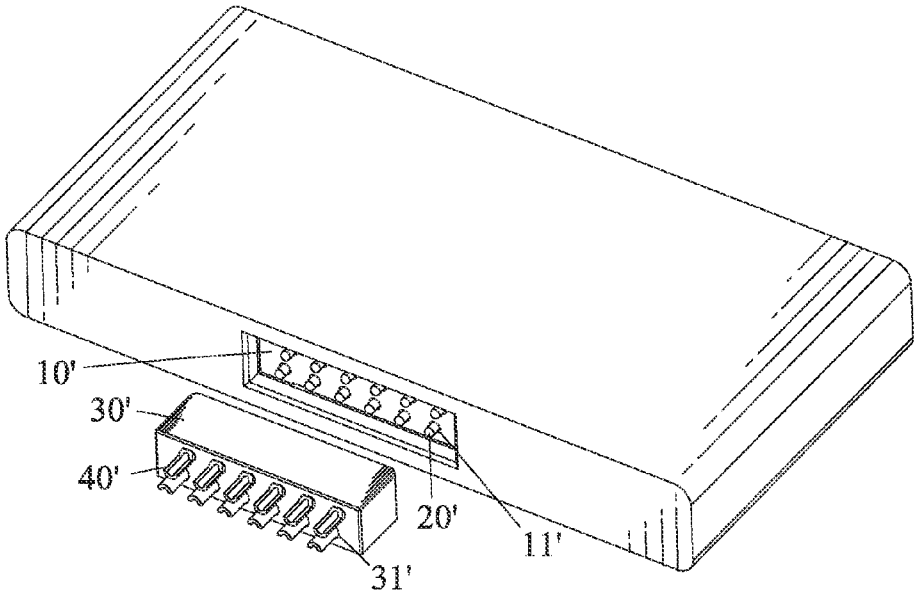
FIG. 5 (Prior Art)
FIG. 5 is a perspective view of a conventional pogo pin connector assembly.

With reference to FIG. 3 and FIG. 4, the pogo pin connector 1 includes a supporting body 10 and at least one probe terminal 20.

The supporting body 10 is a substantially rectangular body. A top face of the supporting body 10 is concaved downward to form a slide slot 11 extending along a front-to-rear direction and penetrating through the back end of the supporting body 10. The back end of the supporting body 10 is concaved inward to form a blocking groove 12. The supporting body 10 defines at least one fastening hole 13 penetrating vertically through the supporting body 10. The fastening hole 13 has a first fastening groove 131 concaved upward from a bottom face of the supporting body 10, a third fastening groove 133 concaved downward from the top face of the supporting body 10, and a second fastening groove 132 connecting between the first fastening groove 131 and the third fastening groove 133. The second fastening groove 132 is smaller than the first fastening groove 131 and greater than the third fastening groove 133 in diameter. When the number of the fastening hole 13 is more than one, the fastening holes 13 of the supporting body 10 are arranged in regular array or array of dislocation. In this embodiment, the fastening holes 13 of the supporting body 10 are arranged in two rows between which the slide slot 11 extends.

The probe terminal 20 is inserted upward in the fastening hole 13 of the supporting body 10. The probe terminal 20 has a barrel 21, a plunger 22 elastically inserted in the barrel 21 and projecting out of a top end of the barrel 21, and a soldering portion 23 formed at a bottom end of the barrel 21 and having a greater diameter than the barrel 21.

With reference to FIG. 2 and FIG. 4, the docking connector 2 includes an insulating body 30 and at least one docking terminal 40.

The insulating body 30 is a substantially rectangular body. A bottom face of the insulating body 30 protrudes downward to form a slide rib 31 extending along a front-to-rear direction. A positioning lump 32 is protruded downward at the bottom face of the insulating body 30 and located behind a rear end of the slide rib 31. A bottom face of a front end of the insulating body 10 is defined as a slope 36. A guiding lump 33 is protruded frontward at the slope 36 and is in a straight line with the slide rib 31. The bottom front corner of the guiding lump 33 is designed as chamfer or fillet. The insulating body 30 defines at least one positioning hole 34 corresponding to the fastening hole 13 of the supporting body 10 and penetrating vertically through the insulating body 30. The positioning hole 34 has a first positioning groove 341 concaved upward from the bottom face of the insulating body 30 and a second positioning groove 342 extending upward from a top end of the first positioning groove 341 to penetrate through a top face of the insulating body 30. The bottom face of the insulating body 30 further protrudes downward to form a plurality of convex projections 35. The convex projections 35 and the positioning holes 34 are arranged alternately at intervals along the front-to-rear direction. The positioning holes 34 of the insulating body 30 are arranged in accordance with the arrangement of the fastening holes 13 of the supporting body 10. In this embodiment, the positioning holes 34 of the insulating body 30 are arranged into two rows between which the slide rib 31 extends.

The docking terminal 40 is inserted upward in the positioning hole 34 of the insulating body 30. The docking terminal 40 has a docking portion 41 and a positioning portion 42 extending upward from a top end of the docking portion 41 and having a smaller diameter than the docking portion 41.

Referring to FIG. 4, in assembly of the pogo pin connector 1, the probe terminal 20 is inserted upward in the fastening hole 13 of the supporting body 10. In detail, the barrel 21 of the probe terminal 20 is fixed in the second fastening groove 132 of the fastening hole 13, the plunger 22 of the probe terminal 20 is movably inserted in the third fastening groove 133 of the fastening hole 13 with the top end thereof projecting beyond the top face of the supporting body 10, and the soldering portion 23 of the probe terminal 20 is fixed in the first fastening groove 131 of the fastening hole 13 with a bottom end thereof projecting beyond the bottom face of the supporting body 10. A surface of the supporting body 10 from which the probe terminals 20 project out to electrically connect with the docking terminals 40 is designated as a mating surface (not labeled). The supporting body 10 together with the probe terminal 20 is fixed in a shell (not labeled) with the mating surface of the pogo pin connector 1 apart facing an inner side face of the shell. The shell defines an opening (not labeled) exposing the back end of the supporting body 10 outside. The headmost one of the probe terminals 20 which lastly docks with the docking terminal 40 is defined as contact terminal.

In assembly of the docking connector 2, the docking terminal 40 is inserted upward in the positioning hole 34 of the insulating body 30. In detail, the docking portion 41 of the docking terminal 40 is fixed in the first positioning groove 341 of the positioning hole 34, and the positioning portion 42 of the docking terminal 40 is fixed in the second positioning groove 342 of the positioning hole 34 with the top end thereof projecting beyond the top face of the insulating body 10. One of the docking terminals 40 corresponding to the contact terminal is defined as detecting terminal.

In use, when the pogo pin connector 1 docks with the docking connector 2, the insulating body 30 with the docking terminal 40 passes through the opening of the shell to be slidably combined with the supporting body 10. In detail, the guiding lump 33 of the insulating body 30 guides the slide rib 31 to be positioned in the slide slot 11 of the supporting body 10, and then the slide rib 31 slides along the slide slot 11 to guide the insulating body 30 to slide forward on the supporting body 10 until the positioning lump 32 is blocked in the blocking groove 12. At the same time, the plunger 22 of the probe terminal 20 skims over the convex projections 35 of the insulating body 30 to dock with the docking portion 41 of the corresponding docking terminal 40. When the pogo pin connector 1 and the docking connector 2 are docked with each other completely, the contact terminal electrically contacts with the detecting terminal to do electro-discharge treatment.

As described above, the pogo pin connector assembly 100 utilizes the slide-out combine structure to slidably dock the docking connector 2 with the pogo pin connector 1, so that can save a lot of space. Furthermore, the electro-discharge treatment is done only when the pogo pin connector 1 and the docking connector 2 are docked with each other completely to make the contact terminal electrically contact with the detecting terminal, so that can effectively ensure no arc spark occur before the contact terminal electrically contacts with the detecting terminal.

What is claimed is:

1. A pogo pin connector assembly, comprising:

a pogo pin connector including:

a supporting body defining at least one fastening hole penetrating vertically through the supporting body, a top face of the supporting body being concaved downward to form a slide slot extending along a front-to-rear direction and penetrating through the back end of the supporting body; and at least one probe terminal inserted upward in the fastening hole of the supporting body, the probe terminal having a barrel, a plunger elastically inserted in the barrel and projecting out of a top end of the barrel, and a soldering portion formed at a bottom end of the barrel; and a docking connector including:

an insulating body defining at least one positioning hole corresponding to the fastening hole of the supporting body and penetrating vertically through the insulating body, a bottom face of the insulating body protruding downward to form a slide rib extending along a front-to-rear direction; and at least one docking terminal inserted upward in the positioning hole of the insulating body, the docking terminal having a docking portion and a positioning portion extending upward from a top end of the docking portion;

wherein when the pogo pin connector docks with the docking connector, the slide rib of the insulating body is positioned in the slide slot of the supporting body and slides along the slide slot to guide the insulating body to slide forward on the supporting body until the plunger of the probe terminal electrically docks with the docking portion of the corresponding docking terminal.

2. The pogo pin connector assembly as claimed in claim 1, wherein the fastening holes of the supporting body are arranged in regular array or array of dislocation, and the positioning holes of the insulating body are arranged in accordance with the arrangement of the fastening holes of the supporting body.

3. The pogo pin connector assembly as claimed in claim 2, wherein the fastening holes of the supporting body are arranged in two rows between which the slide slot extends, and the positioning holes of the insulating body are arranged into two rows between which the slide rib extends.

4. The pogo pin connector assembly as claimed in claim 1, wherein the bottom face of the insulating body further protrudes downward to form a plurality of convex projections, the convex projections and the positioning holes are arranged alternately at intervals along the front-to-rear direction.

5. The pogo pin connector assembly as claimed in claim 1, wherein a bottom face of a front end of the insulating body is defined as a slope, a guiding lump is protruded frontward at the slope and is in a straight line with the slide rib.

6. The pogo pin connector assembly as claimed in claim 5, wherein a bottom front corner of the guiding lump is designed as chamfer or fillet.

7. The pogo pin connector assembly as claimed in claim 1, wherein the back end of the supporting body is concaved inward to form a blocking groove, a positioning lump is protruded downward at the bottom face of the insulating body and located behind a rear end of the slide rib, the docking connector slides forward on the pogo pin connector until the positioning lump is blocked in the blocking groove to realize electrical docking of the docking terminal and the corresponding probe terminal.

8. The pogo pin connector assembly as claimed in claim 1, wherein the fastening hole has a first fastening groove concaved upward from a bottom face of the supporting body, a third fastening groove concaved downward from the top face of the supporting body, and a second fastening groove connecting between the first fastening groove and the third fastening groove, the second fastening groove is smaller than the first fastening groove and greater than the third fastening groove in diameter, the barrel of the probe terminal is fixed in the second fastening groove of the fastening hole, the plunger of the probe terminal is movably inserted in the third fastening groove of the fastening hole with the top end thereof projecting beyond the top face of the supporting body, the soldering portion of the probe terminal has a greater diameter than that of the barrel and is fixed in the first fastening groove of the fastening hole with a bottom end thereof projecting beyond the bottom face of the supporting body.

9. The pogo pin connector assembly as claimed in claim 1, wherein the positioning hole has a first positioning groove concaved upward from the bottom face of the insulating body and a second positioning groove extending upward from a top end of the first positioning groove to penetrate through a top face of the insulating body, the docking portion of the docking terminal is fixed in the first positioning groove of the positioning hole, the positioning portion of the docking terminal has a smaller diameter than that of the docking portion and is fixed in the second positioning groove of the positioning hole with the top end thereof projecting beyond the top face of the insulating body.

10. The pogo pin connector assembly as claimed in claim 1, wherein a headmost one of the probe terminals which lastly docks with the docking terminal is defined as contact terminal, one of the docking terminals corresponding to the contact terminal is defined as detecting terminal, when the pogo pin connector and the docking connector are docked with each other completely, the contact terminal electrically contacts with the detecting terminal to do electro-discharge treatment.

* * * * *